United States Patent [19]

Newton et al.

[11] 4,437,312

[45] Mar. 20, 1984

[54] RECOVERY OF POWER FROM VAPORIZATION OF LIQUEFIED NATURAL GAS

[75] Inventors: Charles L. Newton, Bethlehem; Dennis L. Fuini, Schnecksville, both of Pa.

[73] Assignee: Air Products and Chemicals, Inc., Allentown, Pa.

[21] Appl. No.: 241,183

[22] Filed: Mar. 6, 1981

[51] Int. Cl.[3] ..... F01K 17/00

[52] U.S. Cl. ..... 60/648; 60/651; 60/655; 62/52; 62/514 R

[58] Field of Search ..... 60/648, 655, 651, 671; 62/514 R, 52

[56] References Cited

U.S. PATENT DOCUMENTS

| | | | |
|---|---|---|---|
| 2,975,607 | 3/1961 | Bodle | 62/52 |
| 3,266,246 | 8/1966 | Heller et al. | 60/655 |
| 3,479,832 | 11/1969 | Sarsten et al. | 60/648 |
| 3,892,103 | 7/1975 | Antonelli | 60/648 |
| 4,330,998 | 5/1982 | Nozawa | 60/655 |
| 4,372,124 | 2/1983 | Newton et al. | 60/648 |

*Primary Examiner*—William R. Cline
*Assistant Examiner*—John F. McNally
*Attorney, Agent, or Firm*—Geoffrey L. Chase; E. Eugene Innis; James C. Simmons

[57] ABSTRACT

Power is recovered from the vaporization of liquefied natural gas by warming and vaporizing the liquefied natural gas against a first multicomponent stream which is cooled and liquefied. The liquefied multicomponent stream is pumped to an elevated pressure and is warmed and vaporized against a second multicomponent stream which is cooled and liquefied. The warmed first multicomponent stream is heated, expanded through a generator loaded expander and recycled. The liquefied second multicomponent stream is pumped to an elevated pressure, heated, vaporized and expanded through a second generator loaded expander and recycled.

5 Claims, 1 Drawing Figure

RECOVERY OF POWER FROM VAPORIZATION OF LIQUEFIED NATURAL GAS

TECHNICAL FIELD

This invention relates to a method and an installation for recovering power from the vaporization of liquefied natural gas.

BACKGROUND OF THE INVENTION

The prior art recognizes a number of methods for the revaporization of liquefied natural gas with attendant energy savings. Revaporization of liquefied natural gas by means of recycling a condensing medium in heat exchange with the natural gas is disclosed in U.S. Pat. No. 3,479,832. That patent utilizes a single circuit of a multicomponent heat exchange medium which is exchanged with the vaporizing natural gas.

Recovery of power during the vaporization of liquefied natural gas by a single expansion of a condensable circulating refrigerant, such as ethane or propane, is disclosed in U.S. Pat. No. 2,975,607. In addition, the latter patent discloses the use of sea water to provide an ambient heat source for the refrigerant. An improvement of this cycle is described in the paper entitled "Power Generation From Cryogenic Machinery," presented at the LNG-6 Conference held in Tokyo, Japan from Apr. 7–10, 1980 and authored by Shigeetsu Miyahara. The improvement involved reducing the number of modules in the main heat exchanger while still relying on a single expander for power recovery.

U.S. Pat. Nos. 3,293,850 and 3,992,891 disclose power recovery processes employing noncondensing gaseous heat exchange fluids during vaporization of the liquefied natural gas. Both patents require the use of fuel combustion to provide heat input to the exchanging systems. Cascade refrigeration systems for vaporizing liquefied natural gas streams, from which power is recovered by means of expanders, are shown in U.S. Pat. Nos. 3,068,659 and 3,183,666. Both patents disclose the need for heat sources, such as waste heat means or natural gas combustion.

BRIEF SUMMARY OF THE INVENTION

According to the present invention, there is provided a method for recovering power from the vaporization of liquefied natural gas, which method comprises the steps of at least partially liquefying a first multicomponent stream with said liquefied natural gas as the liquefied gas is vaporized, pumping said at least partially liquefied first multicomponent stream to an elevated pressure, warming and at least partially vaporizing said first multicomponent stream by cooling and at least partially liquefying a second multicomponent stream, heating and fully vaporizing said first multicomponent stream, expanding said heated and vaporized first multicomponent stream through a first expander, recovering power from said first expander, recycling said expanded first multicomponent stream to be at least partially liquefied, pumping said at least partially liquefied multicomponent stream to an elevated pressure, heating and vaporizing said second multicomponent stream, expanding said second multicomponent stream through a second expander, recovering power from said second expander, and recycling said expanded second multicomponent stream to be at least partially liquefied by said first multicomponent stream.

The present invention also provides an installation for recovering power for the vaporization of liquefied natural gas, which installation comprises a main heat exchanger in which said liquefied natural gas can be warmed and vaporized by cooling and at least partially liquefying a first multicomponent stream, at least one pump for pressurizing said at least partially liquefied first multicomponent stream, at least one heat exchanger in which said liquefied first multicomponent stream can be warmed and at least partially vaporized by cooling and at least partially liquefying a second multicomponent stream, means for heating and fully vaporizing said first multicomponent stream, a first expander for expanding said heated multicomponent stream, a first conduit for recycling said first multicomponent stream from said first expander to said main heat exchanger, a pump for pressurizing said at least partially liquefied second multicomponent stream, means for heating said multicomponent stream to produce a vapor, a second expander through which said vapor can be expanded, a second conduit for recycling said expanded second multicomponent stream to said heat exchanger, and means for recovering power from said expanders.

DETAILED DESCRIPTION OF THE INVENTION

Figure 1:
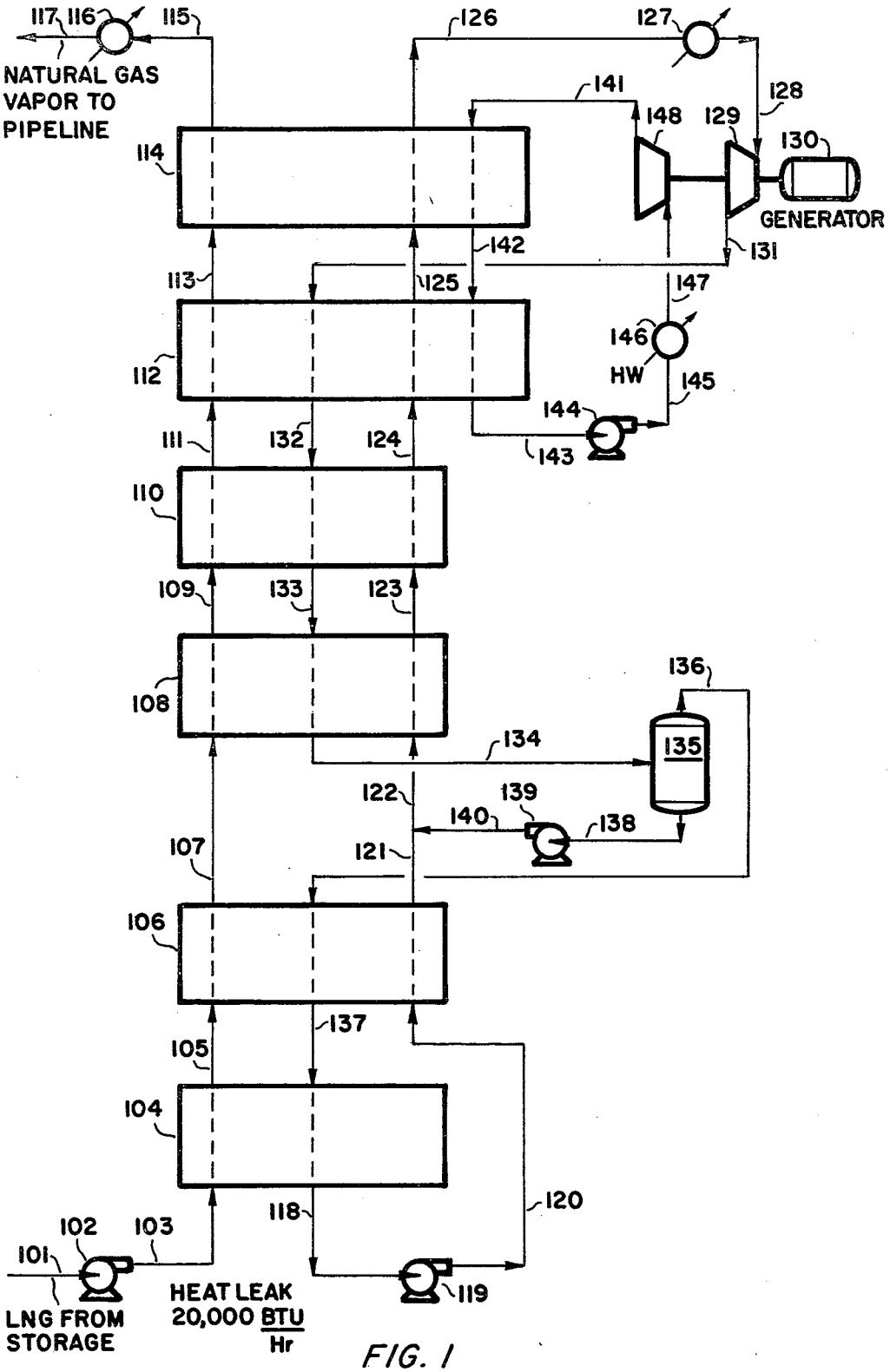
FIG. 1 is a simplified flow scheme of the preferred embodiment of the installation in accordance with the invention.

Natural gas is transported and stored in a liquefied condition in order to provide beneficial economic means for its handling prior to consumption, as in combustion. A significant amount of energy is expended in the liquefaction of natural gas at its source prior to transportation or storage. It would be particularly advantageous to be able to recover these energy inputs at the point where the liquefied natural gas is revaporized. It would also be advantageous in the revaporization of liquefied natural gas to avoid the combustion of even a small percentage of the gas in order to execute the revaporization process. The present invention is directed to such a revaporization process and installation wherein the energy of liquefaction is recovered without the need for the utilization or consumption of even a portion of the natural gas to form the heat of combustion. This objective is achieved with a minimum of capital outlay.

According to the present invention, there is provided a method for recovering power from the vaporization of liquefied natural gas which method comprises the steps of at least partially liquefying a first multicomponent stream with said liquefied natural gas as the liquefied gas is vaporized, pumping an at least partially liquefied first multicomponent stream to an elevated pressure, warming and at least partially vaporizing said first multicomponent stream by cooling and at least partially liquefying a second multicomponent stream, heating and fully vaporizing said first multicomponent stream, expanding said heated and vaporized first multicomponent stream through a first expander, recovering power from said first expander, recycling said expanded first multicomponent stream to be at least partially liquefied, pumping said at least partially liquefied second multicomponent stream to an elevated pressure, heating and vaporizing said second multicomponent stream, expanding said second multicomponent stream through a second expander, recovering power from said second expander, and recycling said expanded second multicomponent stream to be at least partially liquefied by said first multicomponent stream.

Preferably, at least part of said natural gas is used to assist in cooling said second multicomponent stream.

The multicomponent stream mixture could comprise a combination of two components, for example, two halo fluorocarbons. However, a multicomponent mixture comprising at least three components is preferred, for example, two hydrocarbons and nitrogen, three hydrocarbons or three hydrocarbons and nitrogen. Suitable hydrocarbons include methane, ethane, ethylene, propane, propylene, butane, isobutane, pentane, isopentane, and various, mixtures thereof. Particularly preferred as a first multicomponent stream is a mixture comprising methane, ethane and propane. A particularly preferred mixture for the second multicomponent stream comprises ethane, propane and butane. The replacement of ethane with ethylene is also contemplated.

The present invention also provides an installation for recovering power for the vaporization of liquefied natural gas, which installation comprises a main heat exchanger in which said liquefied natural gas can be warmed and vaporized by cooling and at least partially liquefying a first multicomponent stream, at least one pump for pressurizing said at least partially liquefied first multicomponent stream, at least one heat exchanger in which said liquefied first multicomponent stream can be warmed and at least partially vaporized by cooling, and at least partially liquefying a second multicomponent stream, means for heating and fully vaporizing said first multicomponent stream, a first expander for expanding said heated and vaporized first multicomponent stream, a first conduit for recycling said first multicomponent stream from said first expander to said main heat exchanger, a pump for pressurizing said at least partially liquefied second multicomponent stream, means for heating said second multicomponent stream to produce a vapor, a second expander through which said vapor can be expanded, a second conduit for recycling the said expanded second multicomponent stream to said heat exchanger, and means for recovering power from said expanders.

Advantageously, the installation could include an auxiliary heat exchanger which utilizes water of at least 32° F. or ambient air to insure vaporization and proper pipeline temperature of the natural gas.

The present invention specifically contemplates the recovery of energy from the expanders in the form of electricity produced from a generator connected to the expanders.

Additionally, the first multicomponent stream may include a phase separator for identifying and separating the vapor and liquid phase of the first multicomponent stream during the heat exchange function of said stream with the natural gas. Referring to the drawing, 34,410.58 moles per hour of liquefied natural gas comprising (by volume):

$CH_4$: 96.96%
$C_2H_6$:1.61%
$C_3H_8$: 0.73%
$C_4H_{10}$: 0.48%
Other: 0.22% is pumped to 1,347 psia (93 bars A) by pump 102, which it leaves at −245.96° F. (−154.4° C.). The liquefied natural gas is then passed into a series of coil-wound heat exchangers, which it leaves through conduit 115 as a gaseous single phase at −27.84° F. (−33.3° C.). The gaseous phase is warmed in heat exchanger 116, which is warmed by water at 60° F. (15.56° C.) and leaves the installation through conduit 117. The liquefied natural gas, which is to be revaporized in the heat exchangers, passes through a series of exchanger units 104, 106, 108, 110, 112 and 114.

The revaporizing liquefied natural gas is exchanged with a countercurrent flowing stream of a multicomponent fluid passing through conduit 131 at the rate of 32,081 pound mole per hour. The multicomponent mixture comprises (by volume):

$N_2$: 0.9%
$CH_4$: 43.40%
$C_2H_6$: 47.50%
$C_3H_8$: 7.94%
$C_4H_{10}$: 0.1%

The multicomponent fluid in conduit 131 enters the heat exchanger at exchange unit 112. The temperature of the multicomponent fluid at this point is −27.93° F. (−33.3° C.) at a pressure of 89 psia (6.14 bars A). The multicomponent fluid is then cooled through exchange units 112, 110 and 108 to a temperature of −186.43° F. (−121.3° C.) and at a pressure of 80 psi (5.52 bars A). The vapor and liquid multicomponent fluid stream then enters phase separator 135.

The vaporous portion of the multicomponent stream leaves the phase separator 135 through conduit 136 and is reintroduced into the heat exchanger 106 for additional cooling. The vaporous multicomponent stream is liquefied in the lower series of heat exchangers 104, 106 and exits the exchangers through conduit 118 at a temperature of −237.75° F. (−149.8° C.). This liquid is then pumped through pump 119 and conduit 120 to a pressure of 340 psi (23.46 bars A) before being reintroduced into the heat exchanger 106 for warming.

The liquid phase of the multicomponent fluid emanating from the bottom of phase separator 135 is conducted through conduit 138 to pump 139, wherein the pressure of the liquid is raised to 310 psia (21.39 bars A). The liquid is reintroduced into heat exchanger 108 and is combined with the previously separated vapor phase in conduit 122, which is now in the liquid phase.

The remixed liquids rise through heat exchangers 108–114 to be rewarmed from a temperature at conduit 122 of −188.27° F. (−122.3° C.), and a pressure of 310 psia (21.39 bars A) to an exit temperature at conduit 126 of −27.84° F. (−33.1° C.), and a pressure of 245 psia (16.91 bars A) in a predominantly vaporous phase. Residual liquid phase components are vaporized in heat exchange unit 127, wherein the fluid is heated to 50° F. (10° C.) at a pressure of 240 psia (16.56 bars A) by water at 60° F. (15.56° C.). The heated fluid is expanded through expander 129 to a pressure of 89 psia (6.14 bars A). The expanded vaporous multicomponent fluid is then reintroduced through conduit 131 into heat exchanger 112 for recoupment of its heat content by the revaporizing natural gas.

The upper heat exchange units 112 and 114 of the series of heat exchangers incorporate an additional heat exchange cycle of a multicomponent fluid stream. This additional cycle exchanges heat value with the first multicomponent fluid cycle, as well as with the revaporizing natural gas. The second multicomponent stream in conduit 141 consists of an entirely vapor phase at −19.87° F. (−6.2° C.) at a pressure of 24.49 psia (1.69 bars A). This second multicomponent stream consists of (by volume):

$C_2H_6$: 11%
$C_3H_8$: 86%
$C_4H_{10}$: 3.0%

This second multicomponent stream is cooled and liquefied through the heat exchange units 114 and 112 to a temperature of −50° F. (−45.56° C.) at a pressure of 21.49 psia (1.48 bars A). Upon leaving the heat exchangers, the second multicomponent fluid stream is pumped through pump 144 to a pressure of 87.50 psia (6.04 bars A) and is subsequently heated in heat exchanger 146 to a temperature of 50° F. (10° C.) by exchanging with water at 60° F. (15.56° C.). At this point, the second multicomponent stream is entirely in the vapor phase and is expanded through expander 148 to complete its cycle. The expansion of the second multicomponent fluid stream is from 87.5 psia to 24.49 psia.

Power from the expanders 129 and 148 is transmitted to a generator 130 for the production of electrical power. The generator produces a net 7,453 kilowatts of electrical power after providing the power for pumps 119, 139 and 144. This does not include the power for pumping hot water through heat exchange units 127 and 146, or the pump 102 for conducting liquid natural gas from storage.

Various modifications to the installation described can be made, for example, heat exchangers 127 and 146 could be eliminated where the respective expanders can operate efficiently in the presence of liquid.

What is claimed is:

1. A method for recovering net power from the vaporization of liquefied natural gas against multicomponent streams, which method comprises the steps of:

(a) at least partially liquefying a first multicomponent stream with said liquefied natural gas as the liquefied gas is vaporized.

(b) phase separating said first multicomponent stream of step (a) into a vapor phase, which is further cooled to liquefaction against vaporizing liquefied natural gas, and a liquid phase, which is pumped to an elevated pressure.

(c) pumping said liquefied vapor phase multicomponent stream of step (b) to an elevated pressure and combining the same with the liquid phase from the phase separation, (d) warming and at least partially vaporizing said first multicomponent stream by cooling and at least partially liquefying a second multicomponent stream, (e) heating and fully vaporizing said first multicomponent stream, (f) expanding said heated and vaporized first multicomponent stream through a first expander, (g) recovering power from said first expander, (h) recycling said expanded first multicomponent stream to be at least partially liquefied.

(i) pumping said at least partially liquefied second multicomponent stream to an elevated pressure, (j) heating and vaporizing said second multicomponent stream, (k) expanding said second multicomponent stream through a second expander.

(l) recovering power from said second expander, and (m) recycling said expanded second multicomponent stream to be at least partially liquefied by heat exchange with said first multicomponent stream.

2. A method according to claim 1, wherein said multicomponent mixtures comprise methane, ethane, propane and nitrogen.

3. An installation for recovering net power from the vaporization of liquefied natural gas, which installation comprises:

(a) a main heat exchanger in which said liquefied natural gas can be warmed and vaporized by cooling and at least partially liquefying a first multicomponent stream, (b) a phase separator vessel for separating said first multicomponent stream into a vapor phase and a liquid phase, (c) a first pump for pressurizing said liquefied phase of said first multicomponent stream, (d) at least one heat exchanger for warming and vaporizing said liquefied natural gas and liquefying the vapor phase stream of step (b), (e) a second pump for pressurizing said liquefied vapor phase multicomponent stream of step (d), (f) means for combining the liquid phase and the liquefied vapor phase of said first multicomponent refrigerant, (g) at least one heat exchanger in which said liquefied first multicomponent stream can be warmed and at least partially vaporized by cooling and at least partially liquefying a second multicomponent stream, (h) means for heating and fully vaporizing said first multicomponent stream, (i) a first expander for expanding said heated and vaporized first multicomponent stream, (j) a first conduit for recycling said first multicomponent stream from said first expander to said main heat exchanger, (k) a pump for pressurizing said at least partially liquefied second multicomponent stream, (l) means for heating said second multicomponent stream to produce a vapor, (m) a second expander through which said vapor can be expanded, (n) a second conduit for recycling said expanded second multicomponent stream to said heat exchanger, and (o) means for recovering power from said expanders.

4. An installation according to claim 3 including an auxiliary heat exchanger utilizing water of at least 32° F. or ambient air to insure vaporization and proper pipeline temperature of said natural gas.

5. An installation according to claim 3 or 4 wherein an electric generator is the means to recover power from said expanders.

* * * * *